United States Patent [19]

Dicks et al.

[11] 3,960,715

[45] June 1, 1976

[54] CATIONIC FROTH FLOTATION PROCESS

[75] Inventors: Mason L. Dicks, Keewatin; James B. Morrow, Hibbing, both of Minn.

[73] Assignee: The Hanna Mining Company, Cleveland, Ohio

[22] Filed: Jan. 7, 1974

[21] Appl. No.: 431,292

[52] U.S. Cl. ..... 209/166
[51] Int. Cl.[2] ..... B03D 1/02
[58] Field of Search ..... 209/166, 167

[56] References Cited

UNITED STATES PATENTS

| | | | |
|---|---|---|---|
| 2,217,684 | 10/1940 | Kirby | 209/166 |
| 2,383,467 | 8/1945 | Clemmer | 209/160 |
| 2,410,021 | 10/1946 | DeVaney | 209/166 |
| 2,483,890 | 10/1949 | DeVaney | 209/166 |
| 3,292,780 | 12/1916 | Frommer | 209/166 X |

*Primary Examiner*—Robert Halper
*Attorney, Agent, or Firm*—Donnelly, Maky, Renner & Otto

[57] ABSTRACT

An improved cationic froth flotation process for the separation of silicious gangue particles from oxidic iron mineral particles wherein the silicious particles are induced to float, and the iron mineral particles remain in suspension near the bottom of the flotation cell. More particularly, the invention relates to an improvement in the cationic froth flotation process by the incorporation of a small amount of a Group II metal salt as a modifier. The recovered iron concentrates obtained by the improved procedure of the invention are of a higher grade and contain lesser amounts of silicious material.

6 Claims, 1 Drawing Figure

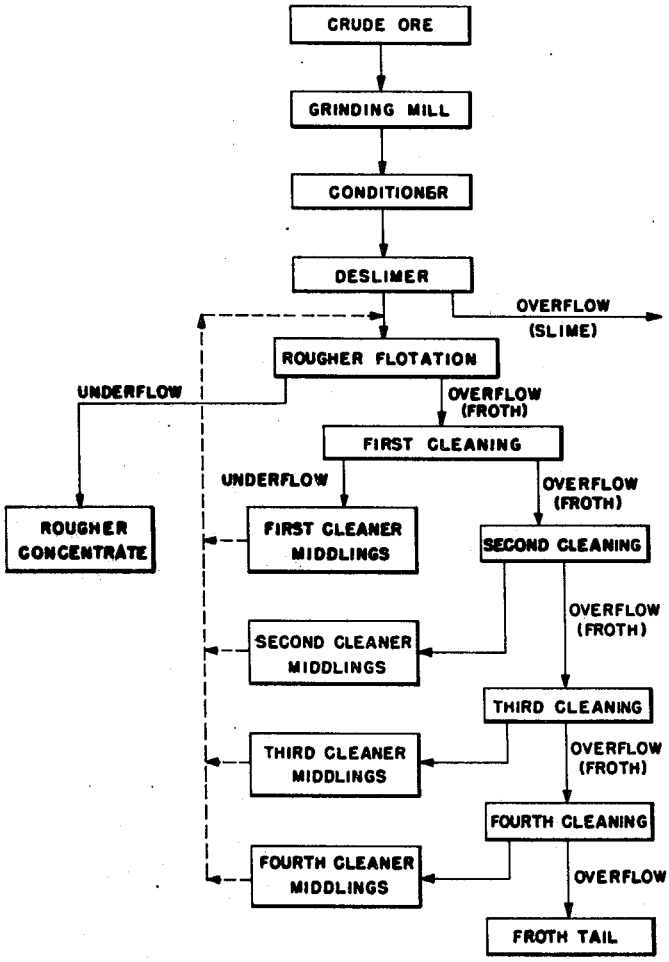

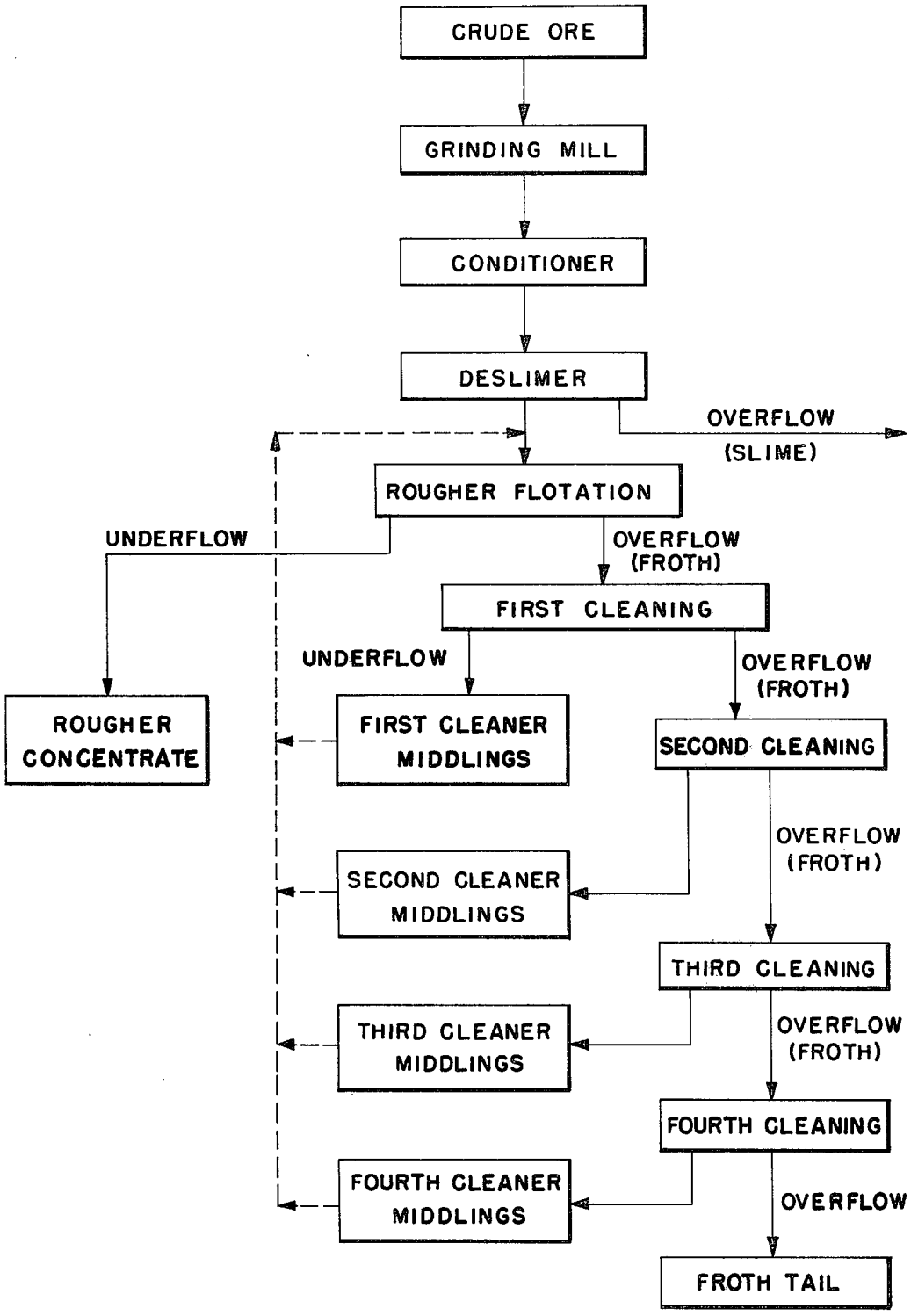
CRUDE ORE
GRINDING MILL
CONDITIONER
DESLIMER
OVERFLOW
(SLIME)
ROUGHER FLOTATION
UNDERFLOW
OVERFLOW
(FROTH)
FIRST CLEANING
UNDERFLOW
OVERFLOW
(FROTH)
ROUGHER
CONCENTRATE
FIRST CLEANER
MIDDLINGS
SECOND CLEANING
OVERFLOW
(FROTH)
SECOND CLEANER
MIDDLINGS
THIRD CLEANING
THIRD CLEANER
MIDDLINGS
OVERFLOW
(FROTH)
FOURTH CLEANING
FOURTH CLEANER
MIDDLINGS
OVERFLOW
FROTH TAIL

CATIONIC FROTH FLOTATION PROCESS

BACKGROUND OF THE INVENTION

This invention relates generally to a process of upgrading oxidized taconite-type ores, and more particularly relates to such a process in which the ore is upgraded by a flotation treatment with cationic treating agents which selectively separate the silica gangue constituents from the iron ore.

The term "oxidized taconite-type ores" refers to the ferruginous cherts associated with the iron ores found in the Great Lakes region of the North American continent such as those found in the Mesabi Range in Northeastern Minnesota. Such ores include oxidized and semi-taconites. The oxidized taconites contain hematite and geothite as the main iron minerals. The semi-taconites contain the same iron minerals but are iron ores with a more loosely bound structure resulting from oxidation of magnetite and the leaching out of some of the silica, lime and magnesia by weather and other elements. A significant feature of the taconites is that they generally contain substantial amounts of silica along with other gangue materials and only about 40% or less of iron. Because the iron content of such taconite ores is, nevertheless, appreciable, they are a common source of iron for numerous industrial uses. Before the ore is suitable for such uses, however, it should be separated from as much of the silica as possible.

Froth flotation is a common process applied in the art for separating or concentrating minerals such as iron from ore such as taconite. Briefly, the flotation process usually comprises grinding crushed ore, classifying the ground ore in water, treating the classified ore by flotation to concentrate one or more minerals in the froth while the remainder of the minerals of the ore remain in the water pulp, and collecting the minerals in the froth or pulp.

In the case of oxidized taconite-type ores, procedures have been suggested for separating the silica from the iron concentrate either by floating the silica and recovering the iron concentrate as the underflow, or conversely by inducing the silica to sink to the bottom of the cell and recovering the iron concentrate as the overflow. The most popular and preferred procedure for separating iron concentrates from silica appears to be the flotation of the silica and the recovery of the iron concentrate as the cell underflow.

In carrying out the flotation step, various agents and modifiers are added to the ore dispersed in the water and air is introduced into the pulp to form a froth. The froth contains those materials which are not wetted and have an affinity for air bubbles and is withdrawn. These useful reagents are classified as frothers, activators, cellectors, depressors, dispersants, or addition agents depending upon their principal function.

This invention relates to a flotation process which utilizes a cationic collector reagent. In general, the cationic froth flotation processes utilize, in addition to the cationic collector which develops a froth rich in silica and poor in iron, iron depressants such as starch which hinders the iron rich components from being collected by the froth, and frothing agents to facilitate formation of the froth in the cells. Acidic or basic addition agents may be utilized in the flotation processes primarily to regulate pH for optimizing the particular separation.

Considerable effort has been expended to improve the cationic froth flotation procedure to devise more efficient and more economical methods of operation. An objective has been to accomplish as complete a separation as possible resulting in high grade concentrates with minimum loss of the valuable minerals while minimizing the consumption of the relatively expensive cationic collector. Accordingly, a wide variety of cationic collector reagents have been utilized and described in the prior art. For example, U.S. Pat. Nos. 3,363,758 and 3,265,211 describe various amines and amine acetates which give improved results as collector reagents in cationic froth flotation processes.

Efforts to improve the cationic froth flotation processes have continued in view of the increasing demands of the industry for higher quality iron concentrates.

SUMMARY OF THE DISCLOSURE

In accordance with the present invention, the beneficiation of silicious iron ore by cationic froth flotation techniques may be improved by the incorporation of a small amount of a Group II metal salt into the pulp prior to the froth flotation treatment. It has been found that when the Group II metal salt is incorporated into the pulp along with the usual reagents and modifiers, such as starch, amine collector and a frother, the procedure is more efficient and the product obtained is of a high purity. The iron concentrate recovered by the process contains less silica than when the Group II metal salt is omitted from the procedure. Additionally, it has been observed in some instances that increased efficiency of the procedure due to the presence of the Group II metal salt permits the reduction in quantity of the more expensive reagents necessary to effect the cationic flotation.

BRIEF DESCRIPTION OF THE DRAWING

The drawing is a schematic flow diagram which illustrates one example of the procedure of the present invention for upgrading crude oxidized taconite-type ores by reducing the silica content thereof.

DESCRIPTION OF THE PREFERRED EMBODIMENTS

The froth flotation process of this invention for separating silica from an iron ore generally comprises frothing said ore in the presence of a small amount of a Group II metal salt modifier, an iron depressant, a cationic collector agent, and a frothing agent in an aqueous medium maintained at a pH of between about 7.5–10.5. As will be demonstrated hereinafter, the presence of the Group II metal salt in the frothing mixture results in the upgrading of the iron ore by removal of significant quantities of the silica impurities contained in the crude ore. In the above procedure, the silica is removed in the froth while the upgraded iron ore is removed from the bottom of the flotation cell.

The attached drawing illustrates a flow sheet of one preferred form of the process of the present invention. Referring to said flow sheet, a crude oxidized taconite-type ore of the type previously described is advanced to a grinding mill of any standard type where the ore is mixed with water and ground to the desired particle size. Conditioning agents such as sodium hydroxide and/or sodium silicate may be added to the grinding mill prior to the grinding of the crude ore. In one embodiment, sufficient water is added to the grinding mill to provide a slurry containing approximately 70% solids. The slurry is removed from the grinding mill and conditioned with high speed stirring and thereafter transferred to a beaker or similar container and diluted as desired with water. The pH of this slurry should be maintained at about 10.5 ± 0.5. This slurry is deslimed by incorporating therein a small amount (about 0.5 lb/lt crude) of starch with stirring. The slimes which accumulate at the surface are removed by siphoning. The desliming procedure may be repeated.

The deslimed ore is advanced to the rougher flotation cell and diluted with stirring with water to provide the desired slurry. To the slurry there is added the various flotation reagents including the Group II metal salts modifiers, the iron depressants (starch) the amine collectors, and the frothing agents as required by this invention. Alternatively, the reagents may be added to the deslimed ore before it is fed to the rougher flotation cell. The flotation cell may be any of the well-known flotation equipment including the Denver laboratory flotation machine and the Wemco Fagergren laboratory flotation machine wherein the slurry mixture is agitated and air is injected near the bottom of the cell as desired. The pH of the slurry in the rougher flotation cell is maintained at between about 7.5 and 10.5 for optimum iron recoveries.

In the rougher flotation treatment, the silica impurities are selectively separated from the ore and removed with the flotation froth. The concentrate from the flotation treatment, i.e., the iron ore containing insufficient silica to float to the top of the cell and become a part of the froth, is removed from the flotation as the underflow and isolated as the rougher concentrate. This iron ore concentrate generally is found to contain a sufficiently low quantity of silica to be suitable for almost any desired use.

The overflow or froth from the rougher flotation is advanced to a first cleaner flotation cell where a second flotation treatment is effected. The underflow from this first cleaning flotation cell is an iron concentrate identified as the first cleaner middlings which generally will contain more silica than the rougher concentrate but significantly less silica than the original crude ore. The overflow frothing from the first cleaning cell is advanced to a second cleaning flotation cell where the flotation procedure is repeated and another iron concentrate is obtained which is identified as the second cleaner middlings.

In the preferred embodiment illustrated in the drawing, the froth flotation cleaning is repeated for a total of four cleanings thereby providing a total of four cleaner middlings and a final overflow froth tail. Any or all of the cleaner middlings may be combined with a rougher concentrate to provide an upgraded iron ore concentrate. The extent to which the rougher concentrate is combined with the various middling fractions will depend upon the desired iron content of the final product derived from the procedure. As an alternative embodiment, the cleaner middlings may be returned and recycled through the rougher flotation cell to further upgrade these cleaner middlings. This recycling of the cleaner middlings is illustrated in the flow sheet of the drawing by the broken lines.

Many cationic reagents are suitable for use in the flotation treatment of this invention. Examples of such collectors include aliphatic amines containing generally from about 8 to about 20 carbon atoms. Typically, the aliphatic amines derived from various petroleum, animal and vegetable oils are most commonly used. Specifically, octyl amine, decyl amine, dodecyl amine, tetradecyl amine, hexadecyl amine, octadecyl amine, octadecenyl amine and octadecadienyl amine are useful. Quaternary amines such as dodecyl trimethyl ammonium chloride, coco trimethyl ammonium chloride, tallow trimethyl ammonium sulfate are also useful. Mixed amines, diamines and quaternary amines, such as tallow amine, hydrogenated tallow amine, coconut aoil or cocoamine, soybean oil or soya-amine, tall oil amine, rosin amine, tallow diamine, coco diamine, soya diamine or tall oil diamines and the like, and quaternary ammonium compounds derived from these amines, are also useful. Amido amines and imidazolines such as those derived from the reaction of an amine and a fatty acid can also be used. Ether amines also are useful.

The amine collectors are usually partially or wholly neutralized by a mineral or organic acid such as hydrochloric acid or acetic acid. Such neutralization facilitates dispersibility in water. In the alternative, the amine may be used as a free base amine by dissolving it in a larger volume of a suitable organic solvent such as kerosene, pine oil, alcohol, and the like before use. It should be noted that these solvents sometimes have undesirable effects in flotation such as reducing flotation selectivity or producing uncontrollable frothing. Although these collectors differ in structure, they are similar in that they ionize in solution to give a positively charged organic ion.

Examples of primary aliphatic ether amine acid salts are described in U.S. Pat. No. 3,363,758. Other amine collectors of the type which are useful in the froth flotation procedure of this invention are described in U.S. Pat. Nos. 2,356,821, 2,410,021 and 3,265,211, and the disclosures thereof are incorporated herein by reference.

Examples of commercially available cationic collectors include: Rosin Amine D Acetate; Armac C; Arosurf MG-83, a product of the Ashland Chemical Company identified as N-tridecoxy-n-proply-1,3-diamine monoacetate; Arosurf MG-98A identified as 3-n-nonoxypropylamine acetate; "Armac 12" produced by the Armour Chemical Company and identified as a lauryl amine acetate; "RD 3286 F" also available from Armour Chemical Company, etc.

The quantity of cationic reagent used may vary over a wide range depending also upon the silica content of the ore being processed, with ores of higher silica content requiring greater quantities of reagent. In general, from about 0.01 to about 2 lbs. of reagent will be used per ton of ore in the flotation feed, and preferably from about 0.1 to about 0.35 lbs. per ton.

Iron depressants also are utilized in the flotation procedure of this invention. The terminology "iron depressant" refers to a water wetting agent which is absorbed by the iron particles and thereby maintains such particles hydrophilic so that they do not absorb the cationic reagent and are, therefore, depressed. In other words, these particles do not float. A number of such compounds are commercially available and are suitable for use in the invention. These include, for example, starch, such as tapioca flour, and a dextrin compound produced by The Corn Products Refinery Company under the trade designation "Gum 9072". The utility of modified starch products as iron depressants in cationic froth flotation procedures is described by DeVaney in U.S. Pat. Nos. 2,483,890 and 2,410,021.

As is customary in flotation treatments, a frothing agent also is incorporated generally in an amount from about 0.001 to 0.2 lb. per ton of ore in the flotation feed. Pine oil, cresylic acid, various alcohols and soaps are typical frothing agents. The reagents are heteropolar organic compounds which reduce surface tension by being absorbed at air-water interfaces and thus facilitate formation of bubbles and froth. Two such commercially available frothing agents are "Dowfroth" produced by the Dow Chemical Company and methylisobutyl carbinol (MIBC).

The flotation equipment utilized for the process of this invention are standard flotation units containing a plurality of communicating cells, and the flotation treatments are therefore series operations with about six or more cells being generally used in the rougher flotation, and about four or less cells used in the cleaner flotation. The ore usually is treated as a slurry of from about 20 to about 40% by weight solids, and the time of treatment generally will be from about 1 to 10 minutes for each circuit although the time is variable to a considerable extent depending upon the silica content, the grain size of the ore being treated and the number of flotation cells involved.

Best results are achieved if the pH of the flotation feed slurry is maintained within a range of from about 7.5 to 10.5 and preferably from about 8.5 to 9.0.

The Group II metal salts which are included in the procedure of this invention may be present in an amount of up to about 3.6 lb/lt of crude ore in the slurry being treated. The salts of magnesium, calcium and barium are preferred, particularly the inorganic salts such as the halides, sulfates, nitrates, etc. Organic salts also are useful such as barium laurate, calcium oleate, etc. Specific examples of inorganic metal salts include barium chloride, calcium chloride, magnesium sulfate, calcium sulfate, etc.

The effectiveness of the Group II metal salts as modifiers in the cationic froth flotation of iron ore is demonstrated in the following examples carried out on iron ores obtained from the Mesabi Iron Range. Unless otherwise indicated, all parts and percentages are by weight. Weights reported as lb/LT indicate weight of reagent in pounds per long ton of crude ore.

EXAMPLE I

Oxidized taconite ore of approximately −10 mesh is fed into a laboratory ball mill and lime softened tap water is added to the mill to make a slurry of 70% solids. Sodium silicate (0.60 lb/LT) and sodium hydroxide (0.90 lb/LT) are added to the grinding mill, and the mixture is ground at 76 rpm for a period of time sufficient to reduce the ore to a size so that approximately 90–92% will pass through a 325 mesh screen. The ground pulp product is removed from the mill, transferred to a four liter beaker, and diluted to about 22% solids using additional lime softened tap water.

To the diluted pulp slurry starch (0.5 lb/LT) is added with stirring to form the selective floccs of the higher grade iron minerals while the lower grade iron and gangue minerals remain in suspension. The suspended slimes are removed by siphoning. The selective floccs or deslimed sands are transferred to a Wemco Fagergren laboratory flotation machine where they are diluted with hard tap water and conditioned with 1.0 lb/LT of a Group II metal salt modifier with the air off for one minute. After this conditioning, an additional 0.5 lb/LT crude of starch is added to the beaker, and the slurry is conditioned with the air off for 3 minutes.

To the above conditioned slurry is added 0.15 lb/LT of Arosurf MG-83 which is principally N-tri-decoxy-n-propyl-1,3-diamine monoacetate. After conditioning the slurry for 0.5 minute, one drop (0.07 lb/LT) of methylisobutyl carbinol (MIBC) frothing agent is added and the slurry is conditioned for 5 to 10 seconds. The air is turned on gradually to develop a froth which is collected in a pan. After about 3 or 4 minutes, the froth formation diminishes and the air is turned off. A second portion (0.16 lb/LT) of MG-83 is added to the slurry which is conditioned for about 30 seconds whereupon an additional drop of MIBC is added. The air is again turned on gradually and the balance of the froth is collected over a period of 3 to 4 minutes.

The cell underflow is the desired iron concentrate which is filtered, dried, weighed and assayed for iron. The cell overfow (froth) collected above is transferred to the cell of a Denver flotation machine where it is diluted to within about 1.25 inches below the cell lip. One drop of MIBC frother is added and the slurry is conditioned for 5 to 10 seconds. The air is turned on gradually and the froth which is developed is collected in a pan. The cell underflow from this first froth cleaning stage is collected by filtration, dried, weighed and assayed for iron. This sample is identified as the first cleaner middlings.

The above cleaning procedure is repeated on the collected froth to provide a total of four cleaner middlings and a final froth tail, all of which are filtered, dried, weighed and assayed for iron content.

In this example, the above procedure is followed utilizing three different modifiers, namely, calcium chloride, barium chloride, and magnesium sulfate. In addition, for comparison purposes, one run is carried out with no modifier. The results which are listed below in Table I demonstrate that the use of the modifier results in the recovery of iron ore containing less silica when compared to the product obtained with the same procedure wherein no modifier is incorporated.

The improved results which is obtained when the modifiers of the present invention are utilized in the cationic flotation procedure further are demonstrated by determining and comparing the percent silica present in the combined concentrate and cleaner middlings at 75% iron distribution. This comparison is summarized below in Table IA.

TABLE I

| | | | | | | | Cumulative | | | |
|---|---|---|---|---|---|---|---|---|---|---|
| Run | Modifier | Product | % Wt. | % Fe | %$SiO_2$ | % Fe Dist. | % Wt. | % Fe | % $SiO_2$ | % Fe Dist. |
| 1 | None | Head Assayed | | 37.52 | | | | | | |
| | | Head Calc. | 100.00 | 38.31 | | 100.00 | | | | |
| | | Conc. | 29.96 | 63.30 | 2.51 | 49.52 | 29.96 | 63.30 | 2.51 | 49.52 |
| | | 1 Cl. | 8.52 | 63.05 | 3.54 | 14.02 | 38.48 | 63.24 | 2.74 | 63.54 |
| | | 2 Cl. | 3.51 | 62.24 | 4.57 | 5.70 | 41.99 | 63.16 | 2.89 | 69.24 |

TABLE I-continued

| Run | Modifier | Product | % Wt. | % Fe | %$SiO_2$ | % Fe Dist. | Cumulative % Wt. | Cumulative % Fe | Cumulative % $SiO_2$ | Cumulative % Fe Dist. |
|---|---|---|---|---|---|---|---|---|---|---|
| | | 3 Cl. | 3.63 | 60.05 | 7.50 | 5.69 | 45.62 | 62.91 | 3.26 | 74.93 |
| | | 4 Cl. | 3.88 | 52.44 | 18.71 | 5.31 | 49.50 | 62.09 | 4.47 | 80.24 |
| | | Froth Tail | 37.47 | 12.48 | | 12.21 | 86.97 | 40.72 | | 92.45 |
| | | Slime | 13.03 | 22.21 | | 7.55 | 100.00 | 38.31 | | 100.00 |
| 2 | $CaCl_2$ | Head Assayed | | 37.52 | | | | | | |
| | | Head Calc. | 100.00 | 38.03 | | 100.00 | | | | |
| | | Conc. | 29.53 | 63.21 | 2.25 | 49.06 | 29.53 | 63.21 | 2.25 | 49.06 |
| | | 1 Cl. | 9.80 | 62.89 | 3.19 | 16.21 | 39.33 | 63.13 | 2.48 | 65.27 |
| | | 2 Cl. | 3.43 | 58.84 | 4.75 | 5.31 | 42.76 | 62.79 | 2.67 | 70.58 |
| | | 3 Cl. | 3.43 | 60.14 | 7.56 | 5.42 | 46.19 | 62.59 | 3.03 | 76.00 |
| | | 4 Cl. | 4.20 | 51.14 | 20.65 | 5.65 | 50.39 | 61.64 | 4.50 | 81.65 |
| | | Froth Tail | 36.38 | 11.10 | | 10.62 | 86.77 | 40.45 | | 92.27 |
| | | Slime | 13.23 | 22.21 | | 7.73 | 100.00 | 38.03 | | 100.00 |
| 3 | $BaCl_2$ | Head Assayed | | 37.52 | | | | | | |
| | | Head Calc. | 100.00 | 38.25 | | 100.00 | | | | |
| | | Conc. | 25.16 | 63.38 | 2.25 | 41.68 | 25.16 | 63.38 | 2.25 | 41.68 |
| | | 1 Cl. | 9.53 | 63.21 | 2.74 | 15.75 | 34.69 | 63.33 | 2.38 | 57.43 |
| | | 2 Cl. | 3.56 | 63.13 | 3.54 | 5.88 | 38.25 | 63.31 | 2.49 | 63.31 |
| | | 3 Cl. | 3.56 | 62.49 | 3.92 | 5.82 | 41.81 | 63.24 | 2.61 | 69.13 |
| | | 4 Cl. | 4.07 | 60.78 | 6.63 | 6.47 | 45.88 | 63.03 | 2.97 | 75.60 |
| | | Froth Tail | 40.91 | 15.64 | | 16.73 | 86.79 | 40.69 | | 92.33 |
| | | Slime | 13.21 | 22.21 | | 7.67 | 100.00 | 38.25 | | 100.00 |
| 4 | $MgSO_4$ | Head Assayed | | 37.52 | | | | | | |
| | | Head Calc. | 100.00 | 38.24 | | 100.00 | | | | |
| | | Conc. | 28.86 | 63.21 | 2.25 | 47.71 | 28.86 | 63.21 | 2.25 | 47.71 |
| | | 1 Cl. | 9.82 | 62.89 | 3.25 | 16.15 | 38.68 | 63.31 | 2.50 | 63.86 |
| | | 2 Cl. | 3.27 | 62.16 | 4.64 | 5.32 | 41.95 | 63.05 | 2.67 | 69.18 |
| | | 3 Cl. | 3.27 | 59.81 | 7.78 | 5.11 | 45.22 | 62.82 | 3.04 | 74.29 |
| | | 4 Cl. | 3.65 | 53.65 | 16.95 | 5.12 | 48.87 | 62.13 | 4.08 | 79.41 |
| | | Froth Tails | 38.03 | 13.05 | | 12.98 | 86.90 | 40.65 | | 92.39 |
| | | Slime | 13.10 | 22.21 | | 7.61 | 100.00 | 38.24 | | 100.00 |

TABLE IA

| Run | Modifier | % $SiO_2$ at 75% Dist. |
|---|---|---|
| 1 | None | 3.28 |
| 2 | $CaCl_2$ | 2.85 |
| 3 | $BaCl_2$ | 2.85 |
| 4 | $MgSO_4$ | 3.12 |

parison purposes, the procedure of this example is repeated without the calcium chloride modifier.

The results of the two runs of this example indicate that the use of the calcium chloride modifier in the cationic froth flotation procedure utilizing demineralized water produces a better grade of iron concentrate. A summary of the results obtained is found in Table II below. The results at 75% iron distribution are summarized in Table IIA.

TABLE II

| Run | Modifier | Product | % Wt. | % Fe | % $SiO_2$ | % Fe Dist. | Cumulative % Wt. | Cumulative % Fe | Cumulative % $SiO_2$ | Cumulative % Fe Dist. |
|---|---|---|---|---|---|---|---|---|---|---|
| 1 | $CaCl_2$ | Head Calc. | 100.00 | 37.99 | | 100.00 | | | | |
| | | Conc. | 31.73 | 63.03 | 2.56 | 52.64 | 31.73 | 63.03 | 2.56 | 52.64 |
| | | 1 Cl. | 9.48 | 61.41 | 5.86 | 15.32 | 41.21 | 62.66 | 3.32 | 67.96 |
| | | 2 Cl. | 3.67 | 58.03 | 10.94 | 5.61 | 44.88 | 62.28 | 3.94 | 73.57 |
| | | 3 Cl. | 4.80 | 44.17 | 31.63 | 5.58 | 49.68 | 60.53 | 6.62 | 79.15 |
| | | 4 Cl. | 6.83 | 26.92 | 57.67 | 4.84 | 56.51 | 56.47 | 12.79 | 83.99 |
| | | Froth Tail | 32.87 | 10.64 | | 9.21 | 89.38 | 39.61 | | 93.20 |
| | | Slime | 10.62 | 24.34 | | 6.80 | 100.00 | 37.99 | | 100.00 |
| 2 | None | Head Calc. | 100.00 | 38.09 | | 100.00 | | | | |
| | | Conc. | 37.06 | 61.90 | 4.43 | 60.25 | 37.06 | 61.90 | 4.43 | 60.25 |
| | | 1 Cl. | 10.18 | 51.90 | 19.11 | 13.87 | 47.24 | 59.75 | 7.59 | 74.12 |
| | | 2 Cl. | 4.27 | 46.42 | 28.22 | 5.20 | 51.51 | 58.64 | 9.30 | 79.32 |
| | | 3 Cl. | 6.53 | 27.64 | 56.57 | 4.74 | 58.04 | 55.15 | 14.62 | 84.06 |
| | | 4 cl. | 7.16 | 16.76 | 73.03 | 3.15 | 65.20 | 50.94 | 21.04 | 87.21 |
| | | Froth Tail | 24.24 | 9.51 | | 6.05 | 89.44 | 39.71 | | 93.26 |
| | | Slime | 10.56 | 24.34 | | 6.74 | 100.00 | 38.09 | | 100.00 |

EXAMPLE II

The procedure of Example I is repeated utilizing calcium chloride (1.0 lb/LT) as the modifier and demineralized water throughout the procedure. The demineralized water added to the ball mill and utilized to dilute the ground pulp to 22% solids in the four liter beaker is adjusted to a pH of 10.5 by the addition of sodium hydroxide. The demineralized water utilized in the flotation cells is adjusted to a pH of 7.0. For com-

TABLE IIA

| Run | Modifier | % Wt. | % Fe | % $SiO_2$ | % Fe Dist. |
|---|---|---|---|---|---|
| 1 | $CaCl_2$ | 46.0 | 62.0 | 4.25 | 75.0 |
| 2 | None | 48.1 | 59.6 | 5.60 | 75.0 |

EXAMPLE III

The procedure of Example I is repeated except that 1.0 lb/LT sodium hydroxide and 1.75 lb/LT sodium silicate are added to the ball mill in addition to the ore. The starch utilized in this example is tapioca.

The flotation treatment is the same as Example I except that only 0.257 lb/LT of reagent MG-83 is utilized and the amount of calcium chloride incorporated is 1.8 lb/LT.

A control run is also carried out on another sample of the same oxidized taconite ore utilizing the same flotation reagents except that no calcium chloride is utilized. The results of these two runs is summarized below in Table III. It can be seen that a better grade of iron concentrate is obtained when the calcium chloride is utilized as a modifier in the flotation procedure.

TABLE III

| Run | Modifier | Product | % Wt. | % Fe | % $SiO_2$ | % Fe Dist. |
|---|---|---|---|---|---|---|
| 1 | None | Head Calc. | 100.00 | 34.10 | | 100.00 |
| | | Conc. | 33.95 | 64.89 | 4.94 | 64.58 |
| | | 1 Cl. | 9.24 | 60.69 | 9.60 | 16.45 |
| | | 2 Cl. | 4.20 | 51.98 | 22.10 | 6.40 |
| | | 3 Cl. | 3.05 | 38.42 | | 3.44 |
| | | 4 Cl. | 2.63 | 23.57 | | 1.82 |
| | | Fr. Tail | 24.03 | 4.68 | | 3.30 |
| | | Slimes | 22.90 | 5.97 | | 4.01 |
| | | Conc. +1 Cl. | 43.19 | 63.99 | 5.94 | 81.03 |
| 2 | $CaCl_2$ | Head Calc. | 100.00 | 34.13 | | 100.00 |
| | | Conc. | 27.51 | 66.57 | 3.16 | 53.67 |
| | | 1 Cl. | 10.18 | 64.15 | 3.73 | 19.13 |
| | | 2 Cl. | 5.04 | 58.19 | 4.83 | 8.59 |
| | | 3 Cl. | 5.23 | 43.84 | | 6.72 |
| | | 4 Cl. | 5.00 | 25.95 | | 3.80 |
| | | Fr. Tail | 22.74 | 6.45 | | 4.30 |
| | | Slimes | 24.30 | 5.32 | | 3.79 |
| | | Conc. + 1&2Cl. | 2.73 | 65.00 | 4.83 | 81.39 |

EXAMPLE IV

Oxidized taconite ore is ground in a ball mill to reduce the size so that approximately 90–92% will pass through a 325 mesh screen, and conditioned for 10 minutes at 70% solids with lime softened water, about 0.67 lb/LT sodium hydroxide, and 1.12 lb/LT sodium silicate. The conditioned pulp is then diluted to a 4 liter volume (22% solids) with lime water, and tapioca in the amount of 0.5 lb/LT is added and stirred into the slurry. The selective floccs are allowed to settle and the overflow is removed by siphoning. The underflow is diluted with 1 liter of lime water, stirred and the floccs again allowed to settle with the second overflow being removed by siphoning and combined with the first overflow to form the total slime. The underflow is the flotation feed at 40% solids which has a pH of about 8.5.

Calcium chloride (0.9 lb/LT) is added to the flotation feed which is conditioned for one minute, and 1.0 lb/LT of tapioca is added followed by 0.17 lb/LT of MG-83 amine collector added in two stages. About 0.10 lb/LT of MIBC frothing agent is added to the slurry, and the air is turned on gradually to develop a froth which is collected. The flow of air is stopped. The cell underflow is the desired iron concentrate which is filtered, dried, weighed and assayed for iron.

The cell overflow (froth) collected above is transferred to a Denver flotation machine where it is diluted to within about 1.25 inches of the cell lip. Tapioca (0.5 lb/LT) and about 0.11 lb/LT of MIBC are added and the slurry conditioned. The air is turned on gradually, and the froth which is developed is collected. The cell overflow from this first froth cleaning stage is collected by filtration, dried, weighed and assayed for iron. This sample is identified as the first cleaner middlings. The above cleaning procedure is repeated on the collected froth without any additional starch to provide a total of four cleaner middlings and a final froth tail, all of which are filtered, dried, weighed and assayed for iron content.

For comparison, the above procedure is repeated with the exception that no calcium chloride modifier is included and 0.25 lb/LT of MG-83 is utilized. The results which are summarized below in Table IV demonstrate the superiority of the procedure when calcium chloride is included as a modifier. It also is determined that at 85% iron distribution, only 4.8% silica is present when calcium chloride is utilized in the procedure as compared to 6.5% silica when the calcium modifier is omitted.

The results of this example also demonstrate that the flotation process can be improved and efficiently conducted with calcium chloride as a modifier even when the amount of cationic amine collector is reduced. Note that the percent silica in the concentrate and the first three middlings is less in Run 1 even though less amine MG-83 is utilized.

TABLE IV

| | | | | | | | Cumulative | | | |
|---|---|---|---|---|---|---|---|---|---|---|
| Run | Modifier | Product | % Wt. | % Fe | % $SiO_2$ | % Fe Dist. | % Wt. | % Fe | % $SiO_2$ | % Fe Dist. |
| 1 | $CaCl_2$ | Head Calc. | 100.00 | 33.50 | | 100.00 | | | | |
| | | Conc. | 24.36 | 66.34 | 2.52 | 48.25 | 24.36 | 66.34 | 2.52 | 48.25 |
| | | 1 Cl. | 10.54 | 62.87 | 6.56 | 19.78 | 34.90 | 65.29 | 3.74 | 68.03 |
| | | 2 Cl. | 5.94 | 62.23 | 7.12 | 11.03 | 40.84 | 64.85 | 4.23 | 79.06 |
| | | 3 Cl. | 3.14 | 59.72 | 9.97 | 5.60 | 43.98 | 64.48 | 4.64 | 84.66 |
| | | 4 Cl. | 2.36 | 48.02 | 26.89 | 3.38 | 46.34 | 63.64 | 5.77 | 88.04 |
| | | Fr. Tail | 26.63 | 6.86 | | 5.45 | 72.97 | 42.92 | | 93.49 |
| | | Slime | 27.03 | 8.07 | | 6.51 | 100.00 | 33.50 | | 100.00 |

TABLE IV-continued

| Run | Modifier | Product | % Wt. | % Fe | % $SiO_2$ | % Fe Dist. | Cumulative % Wt. | Cumulative % Fe | Cumulative % $SiO_2$ | Cumulative % Fe Dist. |
|---|---|---|---|---|---|---|---|---|---|---|
| 2 | None | Head Calc. | 100.00 | 33.49 | | 100.00 | | | | |
| | | Conc. | 21.85 | 66.02 | 2.86 | 43.08 | 21.85 | 66.02 | 2.86 | 43.08 |
| | | 1 Cl. | 11.44 | 63.60 | 5.51 | 21.73 | 33.29 | 65.19 | 3.77 | 64.81 |
| | | 2 Cl. | 4.38 | 61.01 | 8.89 | 7.98 | 37.67 | 64.70 | 4.37 | 72.79 |
| | | 3 Cl. | 4.04 | 58.75 | 11.69 | 7.09 | 41.71 | 64.13 | 5.07 | 79.88 |
| | | 4 Cl. | 3.71 | 49.39 | 25.11 | 5.47 | 45.42 | 62.93 | 6.71 | 85.35 |
| | | Fr. Tail | 28.07 | 10.17 | | 8.52 | 73.49 | 42.78 | | 93.87 |
| | | Slime | 26.51 | 7.75 | | 6.13 | 100.00 | 33.49 | | 100.00 |

EXAMPLE V

The procedure of Example IV is repeated except that the calcium chloride is replaced by 0.9 lb/LT of calcium sulfate. The results which are summarized below in Table V demonstrate the utility of calcium sulfate as a modifier for the cationic froth flotation process.

TABLE V

Results Utilizing $CaSO_4$ as Modifier

| Product | % Wt. | % Fe | % $SiO_2$ | % Fe Dist. | Cumulative % Wt. | Cumulative % Fe | Cumulative % $SiO_2$ | Cumulative % Fe Dist. |
|---|---|---|---|---|---|---|---|---|
| Heads (Calc) | 100.00 | 33.52 | | 100.00 | | | | |
| Conc. | 27.95 | 65.53 | 3.77 | 54.65 | 27.95 | 65.53 | 3.77 | 54.65 |
| 1 Cl. | 9.50 | 62.14 | 7.63 | 17.61 | 37.45 | 64.67 | 4.75 | 72.26 |
| 2 Cl. | 4.38 | 61.18 | 8.46 | 7.99 | 41.83 | 64.30 | 5.14 | 80.25 |
| 3 Cl. | 2.40 | 59.24 | 11.19 | 4.24 | 44.23 | 64.03 | 5.47 | 84.49 |
| 4 Cl. | 1.76 | 47.29 | 27.53 | 2.48 | 45.99 | 63.39 | 6.31 | 86.97 |
| Fr. Tails | 26.68 | 6.46 | | 5.14 | 72.67 | 42.49 | | 92.11 |
| Slime | 27.33 | 9.68 | | 7.89 | 100.00 | 33.52 | | 100.00 |

The embodiments of the invention in which an exclusive property or privilege is claimed are defined as follows:

1. In the method of beneficiating silicious iron ore by cationic froth flotation of the silicious gangue particles from the iron mineral particles in an aqueous pulp of such ore comprising the steps of desliming an aqueous slurry of said ore and thereafter subjecting an aqueous pulp of such ore to a froth-flotation treatment in the presence of a starch depressant, a cationic collector, and a frother, the improvement consisting essentially of the incorporation of a small amount of a Group II metal compound which is a halide, sulfate, or or, nitrate, salt into the pulp after the desliming step and prior to the froth-flotation treatment.

2. The method of claim 1 wherein the pH of the pulp containing the cationic collector, starch, frother and Group II metal compound is maintained between 7.5 and 10.5.

3. The method of claim 1 wherein the Group II metal compound is a Group II metal halide.

4. The method of claim 1 wherein the Group II metal compound is a Group II metal sulfate.

5. The method of claim 1 wherein the Group II metal compound is incorporated in an amount up to about 3.6 pounds per long ton of crude ore.

6. The method of claim 1 wherein the cationic collector is an amine.

* * * * *